United States Patent [19]

Sugiyama

[11] 4,078,464

[45] Mar. 14, 1978

[54] ELECTRONIC MUSICAL INSTRUMENT

[75] Inventor: Shozo Sugiyama, Hirakata, Japan

[73] Assignee: Tadao Kikumoto, Japan

[21] Appl. No.: 730,194

[22] Filed: Oct. 6, 1976

[30] Foreign Application Priority Data

Mar. 26, 1976 Japan ..... 51-34062

[51] Int. Cl.[2] ..... G10H 1/02; G10H 3/10

[52] U.S. Cl. ..... 84/1.01; 84/1.09; 84/1.17; 84/1.27; 84/DIG. 3

[58] Field of Search ..... 84/1.01, 1.09, 1.14, 84/1.16, 1.17, 1.27, DIG. 3, DIG. 15, DIG. 30

[56] References Cited

U.S. PATENT DOCUMENTS

| | | | |
|---|---|---|---|
| 3,555,166 | 1/1971 | Gasser | 84/1.01 |
| 4,006,441 | 2/1977 | Goodrich | 84/1.27 |

FOREIGN PATENT DOCUMENTS

| | | | |
|---|---|---|---|
| 1,211,473 | 2/1966 | Germany | 84/DIG. 15 |
| 706,862 | 4/1954 | United Kingdom | 84/DIG. 15 |

*Primary Examiner*—Edith S. Jackmon

*Attorney, Agent, or Firm*—Eugene E. Geoffrey, Jr.

[57] ABSTRACT

An instrument for producing musical sounds which includes a keyboard, means connected with the keyboard for producing a plurality of musical sounds and means shifting said keyboard in one or more of a plurality of linear and rotational directions to vary such parameters as pitch, loudness, and tone.

3 Claims, 4 Drawing Figures

| | | | | | |
|---|---|---|---|---|---|
| $K_{11}$ | $K_{21}$ | $K_{31}$ | $K_{41}$ | $K_{51}$ | $K_{61}$ |
| $K_{12}$ | $K_{22}$ | $K_{32}$ | $K_{42}$ | $K_{52}$ | $K_{62}$ |
| $K_{13}$ | $K_{23}$ | $K_{33}$ | $K_{43}$ | $K_{53}$ | $K_{63}$ |
| $K_{14}$ | $K_{24}$ | $K_{34}$ | $K_{44}$ | $K_{54}$ | $K_{64}$ |

ELECTRONIC MUSICAL INSTRUMENT

This invention relates to an electronic musical instrument, especially to such instrument having a keyboard which is constructed and arranged in accordance with the theory of cybernetics so that it is possible to play music with ease and sample a number of musical sounds over a wide range of the musical scale with a minimum number of keys.

There are a variety of electronic or electric musical instruments, such as the electronic organ and electric guitar, which have been used widely to produce musical sounds, so called electronic sounds, which are produced electronically. However, such prior electronic musical instruments not only require a very high playing technique as their keyboards, strings, and frets are imitative of those of classic musical instruments wherein sounds are produced in purely mechanical fashion, but also cannot fully exhibit the possibilities of the electronic musical instrument. Such disadvantages of prior art musical instruments, including electronic musical instruments, originate by reason of the fact that the keys, strings, and frets are arranged over a wide spatial range and the fingers of one hand can cover only a semicircle having a ten centimeter radius at most.

Accordingly, an object of this invention is to provide a novel and improved electronic musical instrument having key members, which correspond to the prior art keys, strings and frets, concentrated within a small area which can be covered easily by the fingers of a single hand and also include means for changing at least one of the three elements of sound, thereby overcoming the abovementioned disadvantages of the prior art.

According to this invention, the electronic musical instrument comprises a main body, a movable portion which can be moved rotationally and/or translationally with respect to said main body, a plurality of keys arranged on said movable portion, a device coupled to said keys for generating musical sounds having temperament scale relationship, and a device interlocked with the movement of said movable portion for changing at least the pitch, tone, and/or intensity of said musical sounds.

Other features and operation of this invention will be described in more detail hereinunder with reference to the accompanying drawings.

In the drawings.

Throughout the drawings, like reference symbols are used to denote corresponding structural components.

Figures 1, 2:
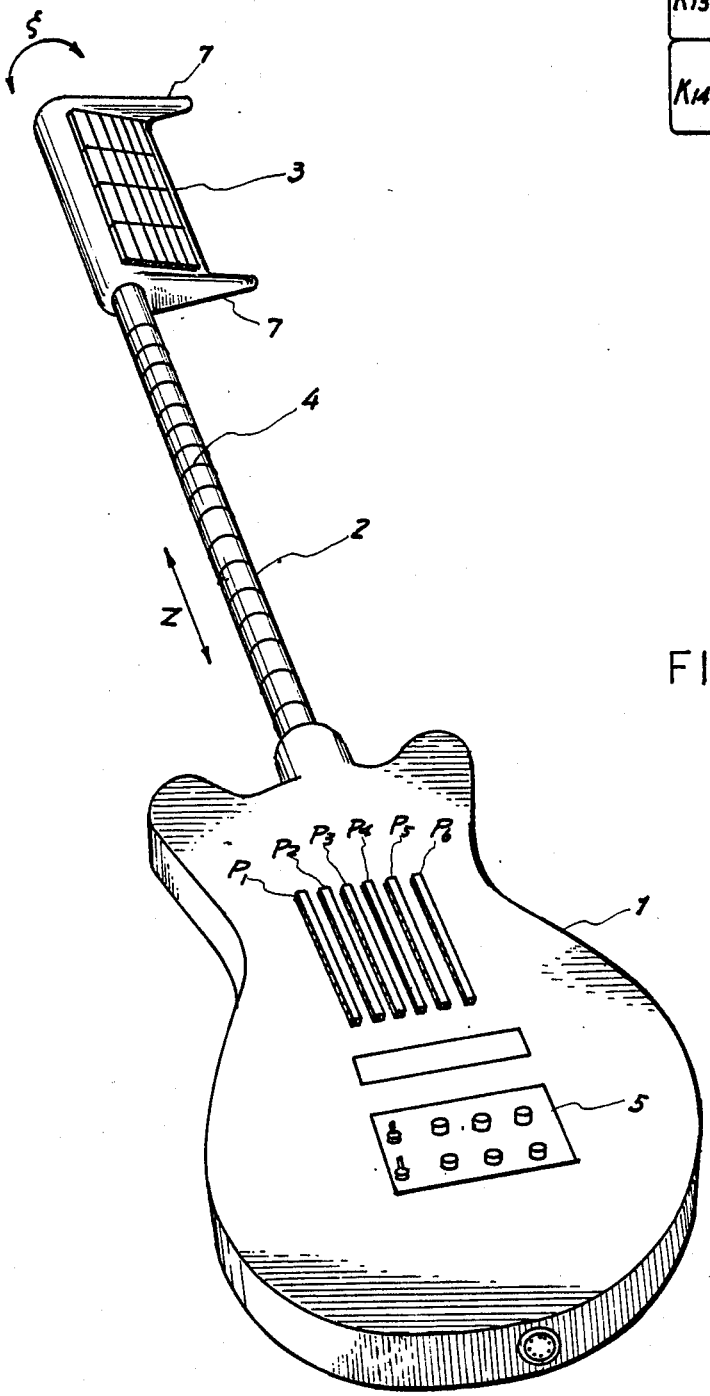
FIG. 1 is a perspective view of one embodiment of the electronic musical instrument of this invention.
FIG. 2 is a plan view of the keyboard of the device of FIG. 1.

Referring first to FIG. 1, the electronic musical instrument of this invention, which simulates a guitar, consists of a main body 1, a rod-shaped neck 2 coupled movable relative to the main body 1 and a keyboard 3 fixed at the top of the neck 2. The neck 2 is slidably coupled with the main body 1 so that it can move in and out of the body 1 the direction of arrow Z and also rotate about its axis as shown by an arrow Ξ. The neck 2 may have graduations 4 for convenience of performance as described later.

The body 1 includes thereon six picking keys P1, P2, P3, P4, P5, and P6 and a control board 5 for controlling the musical sounds. As will be described later, the picking keys P1, P2, . . . P6 are actuating members of six normally-open switches for producing six groups of musical sounds. The keyboard 3 includes a four-row six-column array of twenty-four keys K11 to K21, K31 to K34, K51 to K54, and K61 to K64, as shown in detail in FIG. 2, and a pair of projections 7 which serve as stops and to facilitate the movement of the neck 2 in the Z-direction.

When the instrument of this invention is played, the musical scale is selected by positioning the neck 2 in the Z-direction by the aid of the graduations or fret marks 4, the musical intervals are sampled by pushing the keys on the keyboard 3 with the left hand and the musical sounds are produced by picking the picking keys on the body 1 actuated by the right hand. Although this performance resembles that of a guitar, it is much easier than the guitar since the left hand is always fixed on the keyboard 3 and need not be moved over the length of the fret board.

Figure 3:
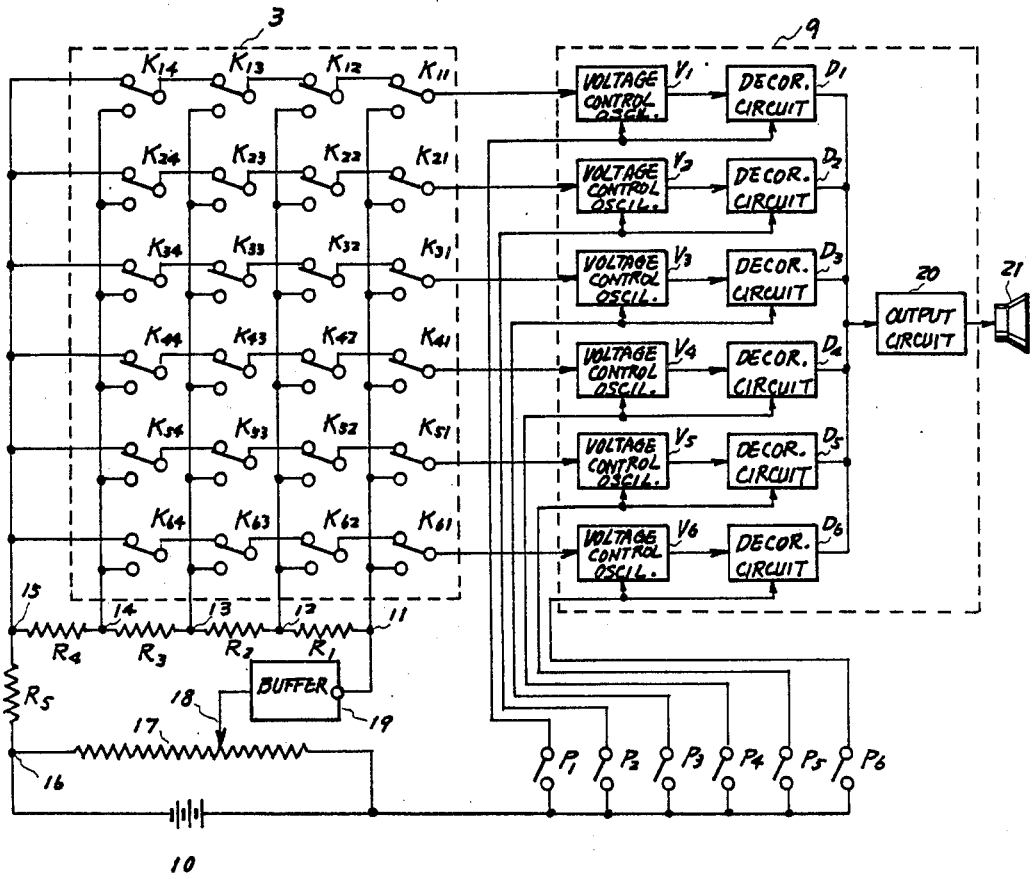
FIG. 3 is a circuit diagram of an embodiment of electric circuit used for the device of FIG. 1.

The circuit configuration of the instrument of FIG. 1 is shown in FIG. 3. A switch matrix 3 corresponds to the keyboard 3 of FIG. 1 and includes twenty-four single-pole double-throw switches K11, . . . K64 corresponding respectively to the keys K11, . . . K64 of FIG. 2 and being arranged also in a four-row six-column array. The switch matrix 3 includes five resistors R1, R2, R3, R4, and R5 connected in series in that order at junctions 12, 13, 14, and 15. The front end junction 11 and the junctions 12, 13 and 14 of the series resistors are respectively connected to first fixed contacts of the switches of the first, second, third and fourth columns, while the junction 15 is connected to second fixed contacts of the switches K14, K24, . . . K64 of the fourth column. The second contacts of the switches of the each row are connected in series through the movable contacts thereof. The movable contact of the each switch is normally in contact with the second fixed contact thereof but is switched to the first fixed contact in response to actuation of the corresponding key on the keyboard 3.

The rear end 16 of the series resistors is connected to one terminal of a constant voltage source 10 and a potentiometer 17 is connected across the source 10. The movable contact 18 of the potentiometer 17 is connected through a buffer 19 to the front end 11 of the series resistors. The movable contact 18 is interlocked with the neck 2 of the instrument and is moved with movement of the neck 2 in the Z-direction (FIG. 1). The buffer 19 serves the function of preventing the potentiometer function from being affected by the load variation caused by switching of the matrix 3.

The movable contacts of the switches K11, K21, . . . K61 in the first column of matrix are respectively connected to the control inputs of six voltage controlled oscillators V1, V2, . . . V6 and the outputs of these oscillators are supplied through six decoration circuits D1, D2, . . . D6 and a common output circuit 20 to a speaker 21. As shown, the oscillators, decoration circuits and output circuit comprise a musical sound synthesizing section 9 of six channels, which may be contained in the body 1. The voltage controlled oscillators V1, V2, . . . V6 are respectively arranged to produce sounds having pitches corresponding to the first, second, . . . sixth strings of a guitar in response to their control input voltages. The each decoration circuit includes a waveform modifying circuit, volume control circuit and the like which may be controlled by the control board 5 on the body 1 (FIG. 1) and serves to change the tone and loudness of the sound to produce a desired musical sound.

The voltage controlled oscillators V1, V2, . . . V6 and the decoration circuits D1, D2, . . . D6 have actuation terminals, respectively, which are connected respectively through six normally-open switches P1, P2, . . . P6 to the other terminal of the constant voltage source 10. The switches P1, P2, . . . P6 are interlocked respectively with the picking keys P1, P2, . . . P6 on the body 1 (FIG. 1) and closed temporarily by pushing the corresponding picking keys. Thus each channel of the musical sound synthesizing section 9 is actuated to produce a musical sound from the speaker 21 in response to closure of the corresponding one of the switches P1, P2, . . . P6.

As the frequencies of musical sounds in the duodecimal temperament scale are related mutually in geometric series, the circuit is arranged to provide the sounds selected by the keys on the keyboard 3 with this frequency relationship. For this purpose, the voltage controlled oscillators V1, V2, . . . V6 are arranged to have the output frequencies proportional to the input control voltages from the switch matrix 3, and the resistors R1, R2, . . . R5 are selected to satisfy the following equation.

$$\frac{R1+R2+R3+R4+R5}{R1+R2+R3+R4}=\frac{R2+R3+R4+R5}{R2+R3+R4}=\frac{R3+R4+R5}{R3+R4}=\frac{R4+R5}{R4}=\sqrt[12]{2}$$

When this equation is satisfied, the output voltages of the switch matrix 3 have a relationship of geometric progression and the sounds produced always come in the duodecimal temperament scale, regardless of the position of the movable contact 18 of the potentiometer 17, that is, the movement of the neck 2 in the Z-direction.

As described above, when a specific key on the keyboard 3 is pushed and then a corresponding picking key is pushed, the speaker 21 produces a musical sound having a corresponding specific frequency. When two or more keys in different rows on keyboard 3 and corresponding picking keys are pushed, the speaker produces a chord. However, when two or more keys in the same row and a corresponding picking key are pushed, the speaker produces only a single sound having a frequency which is highest of those corresponding to these keys respectively. This performance is quite similar to that of a guitar.

When the movable contact 18 of the potentiometer 17 is moved, the six outputs of the switch matrix 3 vary continuously, while preserving their ratio constant. Therefore, any key can produce a musical sound over a substantially wide range of frequency and, if the output frequency ranges of the oscillators V1, V2, . . . V6 are previously set differently from each other from relatively low to relatively high frequencies, the instrument can cover a very wide range of frequency with only twenty-four keys arranged within a range of handwidth. Moreover, by the neck 2 in the Z-direction with some keys as pushed, the pitches of the sounds can be continuously varied with their chord relationship unchanged. Furthermore, by vibrating the neck 2 in the Z-direction, "vibrato" can be obtained easily.

Although not shown in the drawing, the circuit also includes another potentiometer which is common to all of the six channels and this potentiometer is interlocked with rotational movement of the keyboard 3 as shown by the arrow $\Xi$. This enables easy and free change of tone during the performance. Moreover, though the sound pitch control is undertaken by the longitudinal movement of the neck 2 and the tone control is undertaken by the rotational movement thereof in the above instrument, this invention is not limited thereto and the both functions may be interchanged. Furthermore, the key array on the keyboard 3 need not be regular as shown in FIGS. 1 and 2 but may be irregular, provided the keys are arranged most suitably for chord composition and performance.

Figure 4:
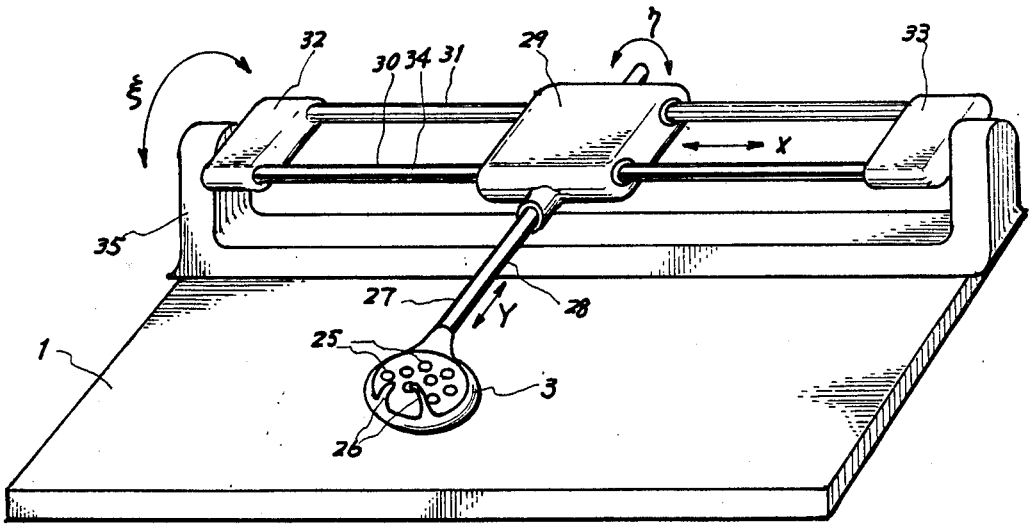
FIG. 4 is a perspective view of another embodiment of this invention.

FIG. 4 shows another embodiment of electronic musical instrument according to this invention. This embodiment is designed to enable the attainment of more functions than the above instrument of FIG. 1, though its shape and structure differ substantially from those of the conventional musical instruments. This instrument includes a round keyboard 3 having a plurality of keys 25 which are arranged irregularly but most suitably for performance within a single-hand region. The keyboard 3 also includes a wrist holder 26 made of resilient material for comfortably holding a wrist.

The keyboard 3 is fixed to an end of a spindle 27 having a longitudinal resistive strip 28 and the spindle 27 is supported by a rectangular supporting member 29 so as to be movable in the longitudinal direction Y and also rotatable about the direction Y as shown by an arrow $\eta$. The supporting member 29 is supported by a pair of guide spindles 30 and 31 which are kept parallel by a pair of coupling members 32 and 33 so that the supporting member 29 can be moved smoothly in a direction X which is substantially orthogonal to the direction Y. The spindle 30 has also a longitudinal resistive strip 34. The resistive strips 28 and 34 contact with separate brushes (not shown) provided in the supporting member 29 to compose two potentiometers for sensing the orthogonal movement of the keyboard 3. The coupling members 32 and 33 are supported by a fork member 35 so that they can rotate about an axis which is parallel to the spindles 30 and 31 as shown by an arrow $\Xi$, and the fork member 35 is fixed on a main body 1 in which a musical sound synthetizing section may be contained. Conventional means are provided for sensing the rotations in the directions $\Xi$ and $\eta$, individually.

In the embodiment of FIG. 4, the keyboard 3 performs four kinds of movement with respect to the main body 1, that is, two orthogonal translations X and Y and two orthogonal rotations $\Xi$ and $\eta$, and these movements are individually sensed and used for selectively determining various elemental factors of the musical sounds, such as strike, tone, loudness, quality and simulation. If the degree of depression of each key is sensed appropriately, the function of the instrument is further expanded.

Although the above description only involves orthogonal movement of the keyboard, cylindrical and polar movements and their combinations are also possible within a scope of this invention. It is also understood that the function of the instrument will be markably expanded by providing two keyboards for operation by both hands.

As above-described, the electronic musical instrument according to this invention possesses the peculiar advantages of both key-type and string-type instruments, and cannot only produce a wide range of musical sounds including chords easily with a limited number of keys but also perform readily such relatively difficult techniques as "vibrato", "portament" and "tremolo".

It should be noted that the above description is made only for illustration purposes and many variations, modifications and changes are also possible without departing from the scope of of this invention as defined by the appended claim. For example, the circuit configuration including the movement sensing means and the synthesizing means can be designed differently from that of FIG. 3, and also, various forms or styles of instrument which look like or unlike those of the conventional musical instruments. The keyboard may be provided preferably with means for locking its movement with respect to the body, such as push button, lever or the like. Moreover, much higher degree of function can be realized by exponentially converting the keyboard voltage and the potentiometer voltage and combining them with a sample-and-hold circuit.

What is claimed is:

1. An electronic musical instrument comprising a main body, a member carried by and selectively movable relative to the main body, a plurality of keys carried by said movable member, means coupled to said keys for generating musical sounds having a temperament scale relationship and means actuated by movement of said movable member for modifying the pitch of the musical sounds produced by said keys.

2. An electronic musical instrument according to claim 1 wherein said member is an elongated element movable linearly relative to said body, one end of said member slidably engaging a cooperating opening in said body and the other end thereof carrying said keys.

3. An electronic musical instrument according to claim 1 wherein said movable member is movable through at least two different paths relative to said body and means coupled to said member for modifying at least two characteristics of the musical sounds produced by said keys.

* * * * *